US006321706B1

(12) United States Patent
Wing

(10) Patent No.: US 6,321,706 B1
(45) Date of Patent: Nov. 27, 2001

(54) VARIABLE VALVE OPENING DURATION SYSTEM

(75) Inventor: Braman C. Wing, Ithaca, NY (US)

(73) Assignee: BorgWarner Inc., Troy, MI (US)

( * ) Notice: Subject to any disclaimer, the term of this patent is extended or adjusted under 35 U.S.C. 154(b) by 0 days.

(21) Appl. No.: 09/635,882

(22) Filed: Aug. 10, 2000

(51) Int. Cl.[7] ..... F01L 13/00; F01L 9/02

(52) U.S. Cl. ..... 123/90.16; 123/90.12; 123/90.49

(58) Field of Search ..... 123/90.12, 90.13, 123/90.15, 90.16, 90.48, 90.49

(56) References Cited

U.S. PATENT DOCUMENTS

| | | | | |
|---|---|---|---|---|
| 3,938,483 | | 2/1976 | Firey | 123/90.12 |
| 4,312,494 | | 1/1982 | Aoyama | 251/48 |
| 4,862,844 | * | 9/1989 | Wakeman et al. | 123/90.12 |
| 5,002,023 | | 3/1991 | Butterfield et al. | 123/90.12 |
| 5,255,639 | * | 10/1993 | Shirey et al. | 123/90.16 |
| 5,503,120 | * | 4/1996 | Shirey et al. | 123/90.12 |
| 5,743,221 | | 4/1998 | Schmitz | 123/90.11 |
| 5,832,885 | * | 11/1998 | Moyer | 123/90.16 |
| 5,839,400 | * | 11/1998 | Vattaneo et al. | 123/90.16 |
| 5,904,226 | | 5/1999 | Sakaguchi et al. | 184/67 |
| 5,943,989 | | 8/1999 | Kira | 123/90.17 |

* cited by examiner

*Primary Examiner*—Weilun Lo
(74) *Attorney, Agent, or Firm*—Emch, Schaffer, Schaub & Porcello Co., L.P.A.; Greg Dziegielewski

(57) ABSTRACT

A valve assembly having a valve (10, 110, 210, 310, 410) that is caused to reciprocate between open and closed positions by engagement of a cam follower (16, 116, 216, 316,416) with a cam (14, 114, 214, 314, 414) that is carried by a rotatable camshaft (12, 112, 212, 312, 412). The valve is resiliently urged against the cam by a coil spring (18, 118, 218, 318, 418), but its return to its closed position is delayed by application of a non-mechanical force against the valve, in opposition to the force imposed by the coil spring, by hydraulic force imposed by hydraulic fluid in a housing (22, 122, 322, 422) that acts against an enlarged portion (10*c*, 110*c*, 310*c*, 410*c*) of the valve, or by an electromagnetic force imposed by an electromagnetic device (228) that acts on an enlarged portion (210*c*) of the valve (210). The non-mechanical, hydraulic imposing force in an embodiment of the invention involves the use of a magneto-rheological fluid within a sealed housing (322), and the viscosity of this magneto-rheological fluid substantially increases when a magnetic coil (330) in the sealed housing is energized.

3 Claims, 4 Drawing Sheets

VARIABLE VALVE OPENING DURATION SYSTEM

BACKGROUND OF THE INVENTION

1. Field of the Invention

This invention relates to the operation of a reciprocable valve of an internal combustion engine. More particularly, this invention relates to a system for selectively varying the rate at which a valve closes from its fully open position.

2. Description of the Prior Art

As is known in the art, for example, as taught by U.S. Pat. No. 5,002,023 (Butterfield et al.), which is assigned to the assignee of this application and the disclosure of which is incorporated by reference herein, the opening and closing of the reciprocable valves of an internal combustion engine, both the intake valves and the exhaust valves, is customarily actuated by irregularly-shaped cams on a rotating shaft, called a camshaft, whose rotation is effected by a chain or belt drive that connects the camshaft to the engine crankshaft, or to another camshaft in a dual camshaft engine. Typically, each valve is spring-biased against a cam of a camshaft, and its opening and closing cycle is precisely determined by the configuration of the cam against which the valve is spring biased. Occasionally, however, it would be advantageous to engine operation to delay the closing of a valve from a pattern it would otherwise follow if it remained in contact with the cam toward which it is spring biased, and to be able to do so selectively.

SUMMARY OF THE INVENTION

According to the present invention, there is provided an apparatus and a method for delaying the closing of an internal combustion engine, cam actuated valve from the rate it would otherwise follow based on contact with a cam of a camshaft against which the valve is resiliently biased. The apparatus and method may take the form of one or another of various embodiments, either hydraulic and/or electric, and most such embodiments permit the delayed closing of the valve to occur selectively, that is, only when desired.

Accordingly, it is an object of the present invention to provide an apparatus and a method for delaying the closing of an internal combustion engine, cam actuated valve from the rate it would otherwise follow based on contact with the cam against which the valve is resiliently biased. More particularly, it is an object of the present invention to provide an apparatus and a method of the foregoing character in which the delayed closing of the valve occurs selectively, that is, only when desired.

DETAILED DESCRIPTION OF THE PREFERRED EMBODIMENT

Figure 1A:
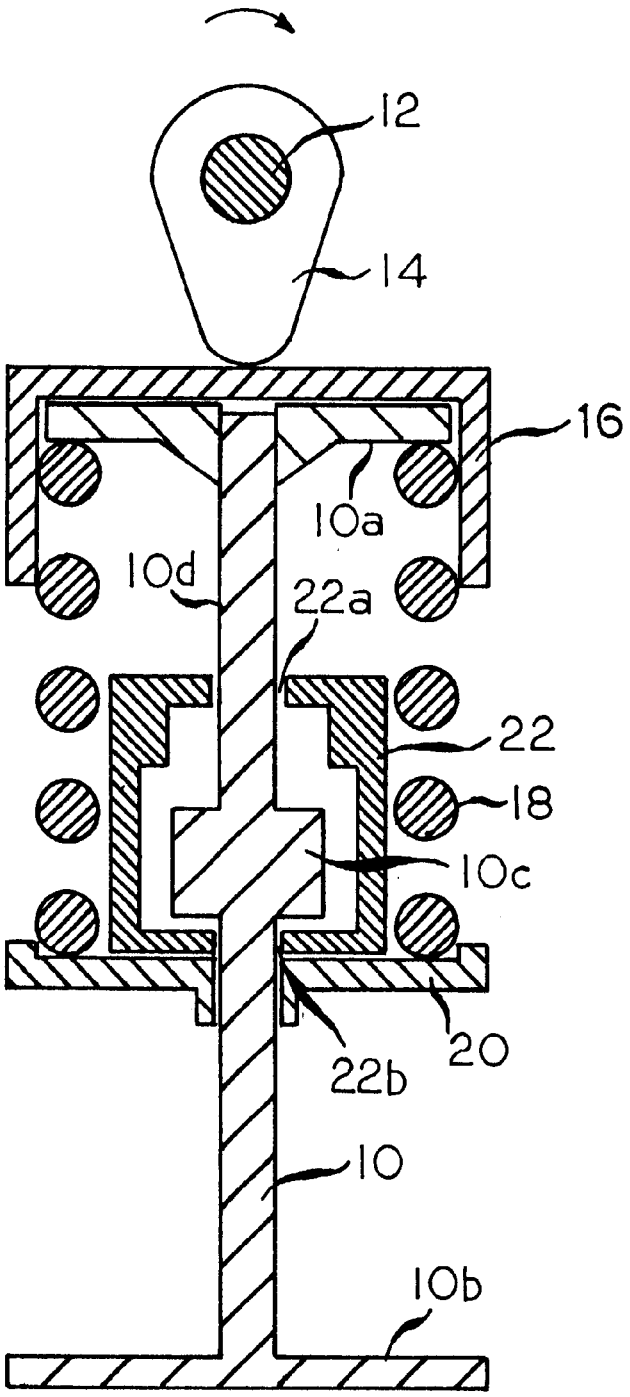
FIGS. 1A, 1B and 1C are schematic views of an internal combustion engine valve and a cam of a camshaft used to operate such valve, according to a preferred embodiment of the present invention, at various times during the rotation of the camshaft.
Figure 1B:
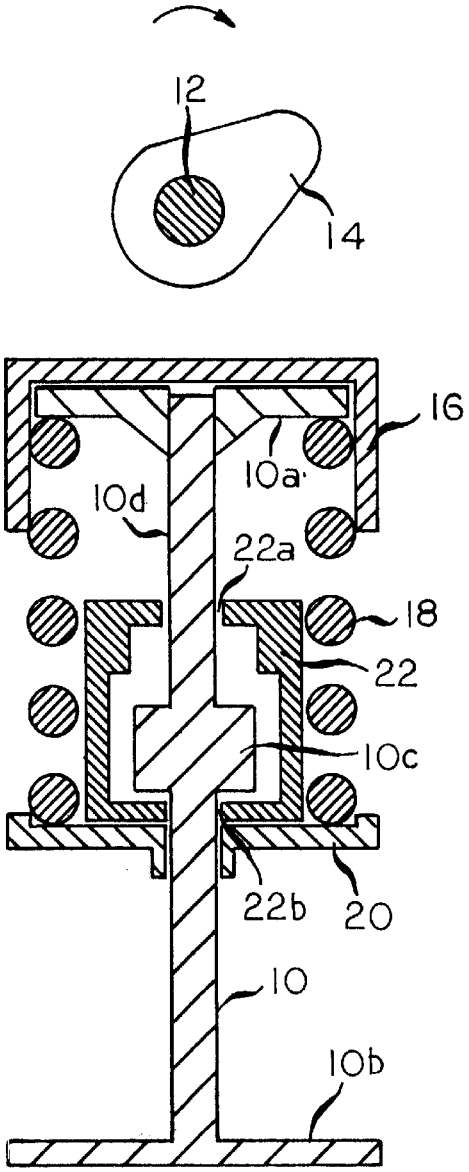
Figure 1C:
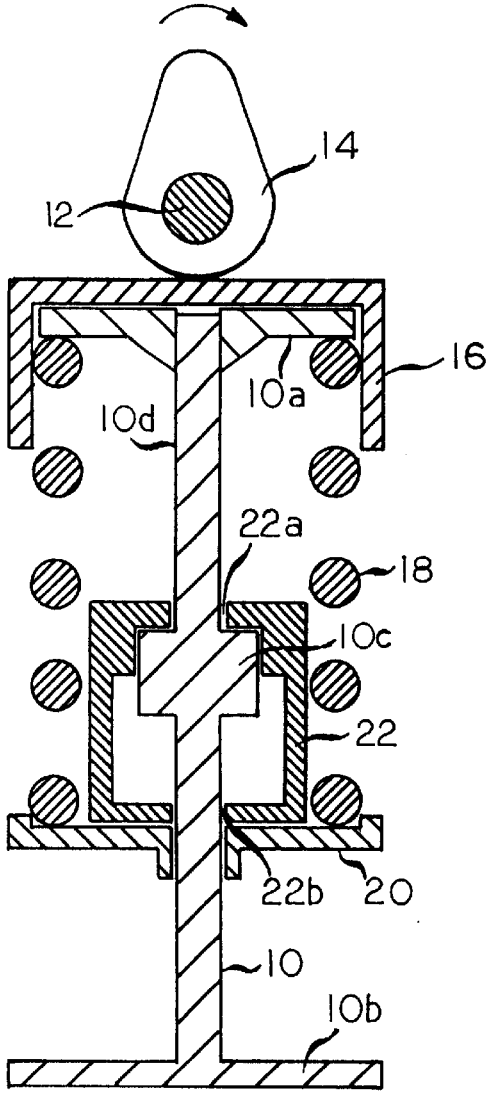

FIGS. 1A, 1B and 1C illustrate the operation of a valve 10 of an internal combustion engine, and it may be considered to be the exhaust valve of one of the cylinders of the engine. The valve 10 is caused to reciprocate along its longitudinal central axis, vertically as shown in the drawing, by the rotation of a camshaft 12, which is caused to rotate by a chain or belt drive from an engine crankshaft or another camshaft in a known manner (by elements not shown). The camshaft 12 has an irregularly shaped cam 14 that rotates therewith, and the cam 14 engages a cam follower 16 in the form of an inverted cup that surrounds an enlarged flange 10*a* at the end of the valve 10, the opposed end of the valve 10 also having an enlarged portion 10*b* that actually functions to open and close an opening in the cylinder that the valve 10 is associated with.

The valve 10 is resiliently biased toward its cylinder closing position, that is, its uppermost position as shown in the drawing, by a coil spring 18, an uppermost end of which engages the inside bottom of the cam follower 16 and the lowermost end of which engages the upper surface of a laterally extending fixed member 20. Thus, the cam follower 16 would tend to remain in contact with the came 14 at all times during the rotation of the camshaft. However, in the arrangement of FIGS. 1A, 1B, and 1C, the return of the cam 10 from its open position in FIG. 1A to its closed position in FIG. 1C is delayed by providing the valve 10 with an enlargement 10*c* and by surrounding the enlargement 10*c* with a housing 22 of sufficient axial extent to permit the travel of the enlargement 10*c* therein throughout the entire range of travel of the valve 10. The housing 22 has aligned openings 22*a*, 22*b* at its top and bottom to permit the reciprocation of the valve 10 with respect to the housing 22, and the openings at 22*a*, 22*b* have sufficient clearance with respect to a stem portion 10*d* of the valve 10 to permit the flow of hydraulic fluid, namely, engine lubricating oil, through the openings 22*a*, 22*b* as the valve 10 moves up and down, the entire valve assembly being immersed in engine lubricating oil. Thus, the viscosity of the engine oil with the housing 22, some of which must be pumped through the opening 22*a* by the enlargement 10*c* as the valve 10 moves from its FIG. 1A position to its FIG. 1B position, will delay the return of the valve 10 to its FIG. 1C position, notwithstanding the biasing force imposed on the cam follower 16 by the coil spring 18. In that regard, the opening 22*b* should be somewhat larger than the opening 22*a*, to permit the free flow of engine lubricating oil into the housing 22 when the valve 10 moves from its FIG. 1B position to its FIG. 1C position and to permit the free flow of engine lubricating oil from the housing 22 as the valve 10 moves from its FIG. 1A position to its FIG. 1C position.

Figure 2:
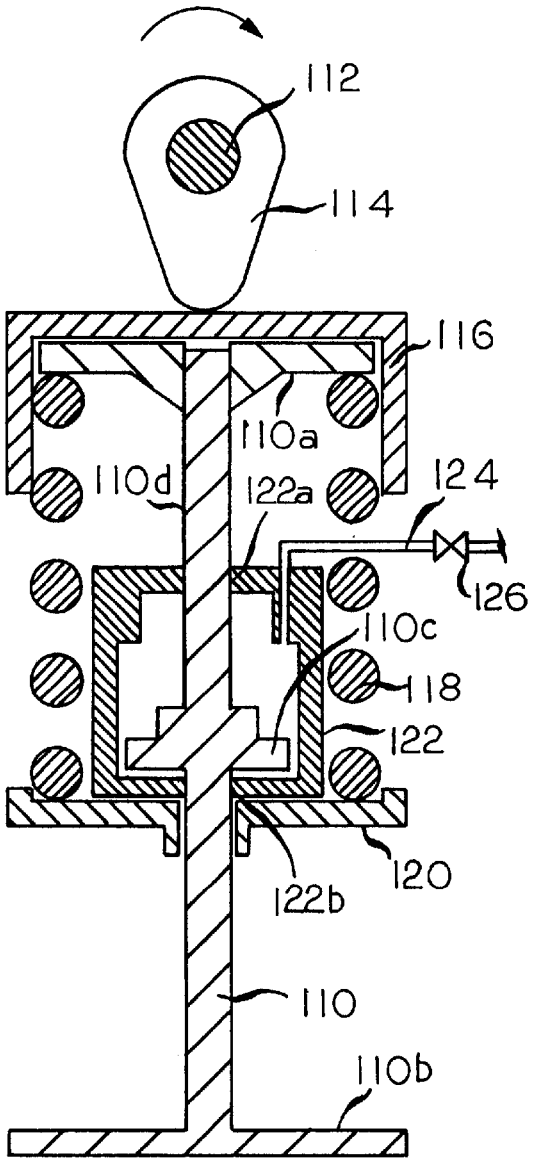
FIG. 2 is a view like FIG. 1A of an alternative embodiment of the present invention.

In the embodiment of FIG. 2, each element that corresponds to an element of the embodiment of FIGS. 1A, 1B and 1C is identified by a three-digit numeral, the last two digits of which are the same as the two digits of the corresponding element of FIGS. 1A, 1B and 1C. In the embodiment of FIG. 2, openings 122*a*, 122*b* of a housing 122 are sealed to prevent the flow of engine lubricating oil therethrough as a valve 110 reciprocates under a downwardly directed force imposed by a cam 114 of a rotating camshaft 112 and a resilient upwardly directed force imposed by the coil spring 118 on an enlarged flange 110*a* of the valve 110. However, the housing 122 does not normally contain engine lubricating oil therein; under these circumstances, therefore, there is no viscous drag on an enlarged portion 110*c* of the valve 110, and a coil spring 118 will be effective to maintain a cam follower 116 in contact with the cam 114 at all times during the rotation of the camshaft 112 when there is no engine lubricating oil in the housing 122. However, when it is desired to delay the return of the valve 110, as it is during certain engine operating conditions, this can be done by the addition of engine lubricating oil to the housing 122 through an inlet/outlet line 124, and the flow of engine lubricating oil into or out of the housing 122 is selectively permitted or prevented by a servo valve 126, whose operation is controlled by an engine control unit of the engine with which the valve 110 is associated (elements not shown). In this way, the delayed return of the valve 110 to its closed position can be regulated, and the duration of its open period extended, as required or desired to achieve improved engine operating conditions, and notwithstanding the biasing return force imposed on the cam follower 116 by the coil spring 118.

Figure 3:
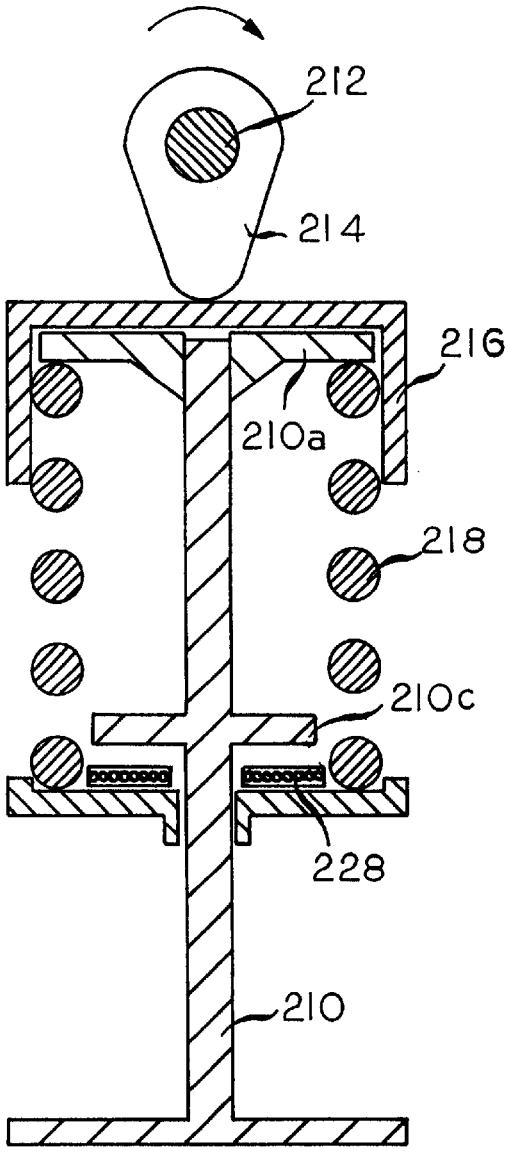
FIG. 3 is a view like FIGS. 1A and 2 of another alternative embodiment of the present invention.

In the embodiment of FIG. 3, each element that corresponds to an element of the embodiment of FIGS. 1A, 1B and 1C, or to an element of the embodiment of FIG. 2, is identified by a three-digit numeral, the last two digits of which are the same as the two digits of the corresponding element of FIGS. 1A, 1B and 1C, or to the last two digits of the corresponding element of FIG. 2, as the case may be. In the embodiment of FIG. 3, the return of a valve 210 from its fully open position, as illustrated in FIG. 3, to a closed position corresponding to the position of the valve 10 that is shown in FIG. 1C, is delayed by an electromagnetic valve holding device 228, which acts on an enlargement 210*c* to magnetically restrain its return against the biasing force of a coil spring 218 against a flange 210*a* of the valve 210 and a cam follower 216. The operation of the electromagnetic valve holding device 228 is selectively energized or deenergized under control by an engine control unit of the engine with which the valve 210 is associated (elements not shown). In this way, the delayed return of the valve 210 to its closed position can be regulated, and the duration of its open period changed, as required or desired to achieve improved engine operating conditions, and notwithstanding the biasing return force imposed on the cam follower 216 by the coil spring 218.

Figure 4:
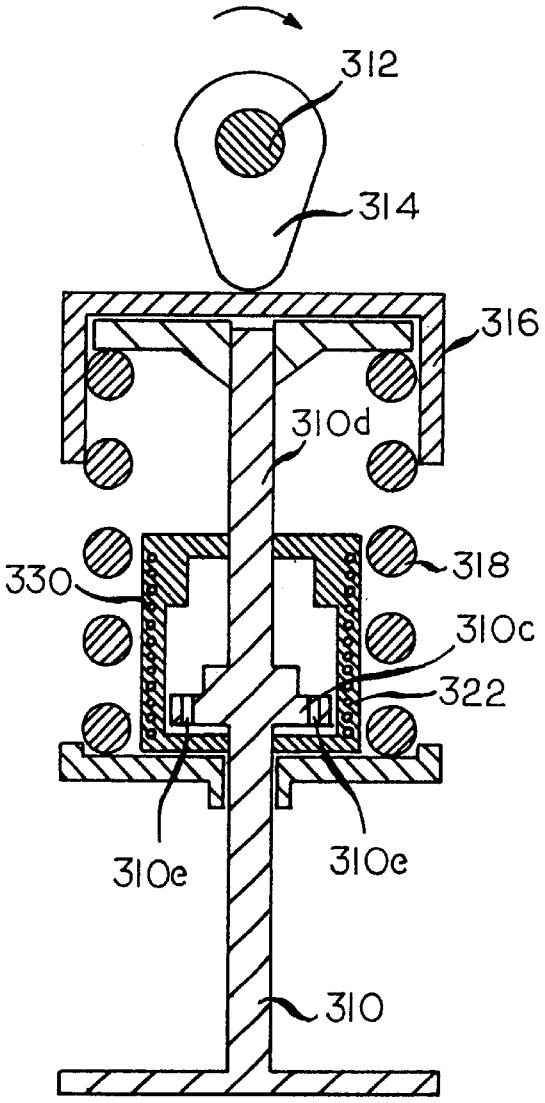
FIG. 4 is a view like FIGS. 1A, 2 and 3 of yet another alternative embodiment of the present invention.

In the embodiment of FIG. 4, each element that corresponds to an element of the embodiment of FIGS. 1A, 1B and 1C, or to an element of the embodiment of FIG. 2, or to an element of the embodiment of FIG. 3, is identified by a 300 series numeral, the last two digits of which are the same as the two digits of the corresponding element of FIGS. 1A, 1B and 1C, or the last two digits of the corresponding element of FIG. 2 or the last two digits of the corresponding element of FIG. 3, as the case may be. In the embodiment of FIG. 4, an enlarged portion 310*c* of a valve 310 is surrounded by an enclosed housing 322 which sealingly accommodates the reciprocation of the valve 310 with respect to the housing 322 at all locations of the travel of the enlarged portion 310*c*. The housing 322 contains a sealed quantity of a magneto-rheological fluid, that is, a fluid whose viscosity materially increases under the influence of an electromagnetic field. The housing 322 contains an electromagnetic coil 330 embedded in its outer wall, and positioned concentrically with a stem 310*d* of the valve 300, and whenever the electromagnetic coil 330 is energized, the viscosity of the fluid contained in the housing 322 increases markedly, to thereby delay the return of the valve 310 from its fully open position, as illustrated in FIG. 4, to its filly closed position corresponding to the position of the valve 10 in FIG. 1C. To prevent excessive viscous forces from operating on the enlargement 310*c* of the valve 310, the enlarged portion 310*c* is provided with apertures 310*e* extending therethrough, to facilitate the flow of fluid from one side of the enlargement 310*c* to the other during periods when the fluid within the housing 322 has a low viscosity.

Thus, when the electromagnetic coil 330 is not energized, a coil spring 318 will be effective to maintain the cam follower 316 in contact with the cam 314 at all times during the rotation of the camshaft 312. However, when it is desired to delay the return of the valve 310, as it is during certain engine operating conditions, this can be done by the energization of the electromagnetic coil 322, and in this way the delayed return of the valve 310 to its closed position can be regulated, and the duration of its open period changed, as required or desired to achieve improved engine operating conditions, and notwithstanding the biasing return force imposed on the cam follower 316 by the coil spring 318.

Figure 5:
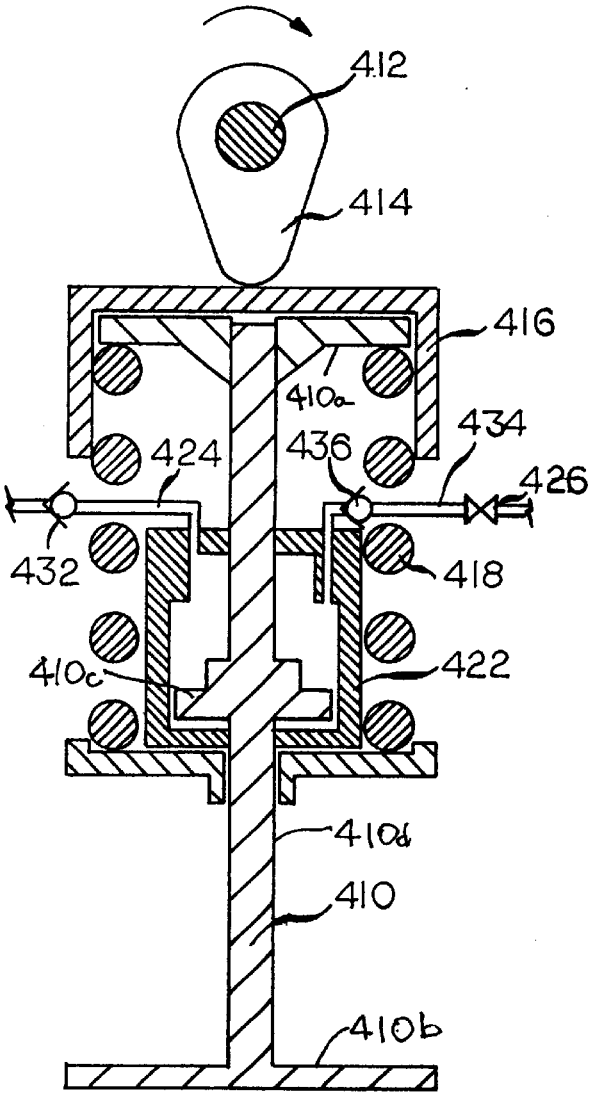
FIG. 5 is a view like FIGS. 1A, 2, 3 and 4 of yet another alternative embodiment of the present invention.

In the embodiment of FIG. 5, each element that corresponds to an element of the embodiment of FIGS. 1A, 1B and 1C, or to an element of the embodiment of FIG. 2, or an element of the embodiment of FIG. 3, or an element of the embodiment of FIG. 4, is identified by a 400 series three-digit numeral the last two digits of which are the same as the two digits of the corresponding element of FIGS. 1A, 1B and 1C, or the same as the last two digits of the corresponding element of FIGS. 2, 3 or 4, as the case may be. In the embodiment of FIG. 5, which is otherwise similar to the embodiment of FIG. 2, lubricating engine oil flows into a sealed housing 422 through an inlet line 424, which is provided with a check valve 432 to allow engine oil to flow freely into a sealed housing 422 during the opening of a valve 410, but prevents oil from flowing back out of the housing 422 into the inlet line 424 during the closing of the valve 410. The embodiment of FIG. 5 also is provided with an outlet line 434 to exhaust oil from the housing 422, and the outlet line 434 is also provided with a check valve 436 to permit oil to be exhausted from the housing 422 during the closing of the valve 410, while also preventing oil from being drawn back into the housing 422 during the opening of the valve 410. The outlet line 434 is also provided with a servo valve 426 to selectively open or close the housing 422 to the flow of oil In the embodiment of FIG. 5, it is possible to provide controlled leakage of oil out of the housing 422 by providing a high speed valve (not shown) to open on each valve stroke during the closing of the valve. A slower responding valve (also not shown) could simply limit the flow out of the housing 422, and therefore the rate at which the valve 410 closes. The use of such a slower responding valve is not as ideal, because it will prevent the valve from remaining fully open, but it will allow several valves to be controlled with one hydraulic valve.

The valve 410 of the embodiment of FIG. 5 has an enlarged flange 410*a*, an enlarged end 410*b* and an elongate stem 410*d* that extends between the enlarged flange 410*a* and the enlarged end 410*b*. The elongate stem 410 is provided with an enlarged portion 410*c* that is surrounded by the housing 422.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

What is claimed is:

1. In an internal combustion engine having a rotatable camshaft (112, 412) with an irregular shaped cam (114, 414) that is rotatable therewith, a valve assembly comprising:

a valve (110, 410) having an enlarged end and an opposed end, said valve being reciprocable along a longitudinal central axis extending between the enlarged end and the opposed end, said valve being reciprocable between an open position of said enlarged end and a closed position of said enlarged end;

a cam follower (116, 416) operatively associated with said opposed end of said valve, said cam follower being positioned to engage said irregularly shaped cam;

resilient means (118, 418) for imposing a biasing force on said cam follower against said cam to urge said valve to the closed position of said enlarged end;

non-mechanical force means (122, 422) for acting on said valve, against the biasing force imposed by said resilient means, for delaying the movement of said valve from the open position of the enlarged end to the closed position of the enlarged end;

wherein said non-mechanical force means comprises means (122, 422) for imposing an hydraulic force on said valve; and means (124, 422) for selectively controlling the application of force by said non-mechanical force means to vary the time involved in the movement of the valve from the open position of the enlarged end to the closed position of the enlarged end; and wherein the valve has an elongate stem (110*d*, 410*d*) extending between said enlarged end (110*b*, 410*b*) and said opposed end (110*a*, 410*a*) and an enlarged portion (110*c*, 410*c*) positioned on the elongate stem between said enlarged end and said opposed end, and wherein said means for selectively controlling the application of force by said non-mechanical force means comprises:

a housing (122, 422) surrounding a portion of said valve stem, said enlarged portion being positioned within said housing, travel of said enlarged portion of said valve stem being entirely within said housing at all times during travel of said valve between the closed position of said enlarged end and the open position of said enlarged end; and wherein said means for selectively controlling comprises means 124, 424) for selectively introducing an hydraulic fluid into said housing and for withdrawing hydraulic fluid from said housing.

2. A valve assembly according to claim 1 wherein said means for selectively introducing an hydraulic fluid into said housing and for withdrawing hydraulic fluid from said housing comprises:

an inlet/outlet line (124); and servo valve means (126) for selectively permitting or preventing hydraulic fluid from flowing through said inlet/outlet line.

3. A valve assembly according to claim 1 and further comprising:

an inlet line (424) for introducing an hydraulic fluid into said housing;

a servo valve (426) for selectively permitting hydraulic fluid to flow through said inlet line Into said housing;

a first check valve (432) in said inlet line for preventing reverse flow of hydraulic fluid through said inlet line;

an outlet line (434) for withdrawing hydraulic fluid front said housing; and a second check valve (435), said second check valve being positioned in said outlet line and preventing return of hydraulic fluid into said housing through said outlet line.

* * * * *